US007040306B2

(12) United States Patent
Moriyama et al.

(10) Patent No.: US 7,040,306 B2
(45) Date of Patent: May 9, 2006

(54) BLOWBY GAS VENTILATION SYSTEM FOR AN INTERNAL COMBUSTION ENGINE, AND METHOD OF USING SAME

(75) Inventors: Ryuji Moriyama, Saitama (JP); Kenji Oki, Saitama (JP); Yuuki Muraoka, Saitama (JP); Ryuji Maeda, Saitama (JP); Kazuo Fujihara, Saitama (JP); Nobuhiro Shimada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/925,219

(22) Filed: Aug. 24, 2004

(65) Prior Publication Data

US 2005/0045164 A1 Mar. 3, 2005

(30) Foreign Application Priority Data

| | | |
|---|---|---|
| Aug. 29, 2003 | (JP) | 2003-305833 |
| Sep. 26, 2003 | (JP) | 2003-336223 |
| Sep. 26, 2003 | (JP) | 2003-336226 |
| Jul. 21, 2004 | (JP) | 2004-213496 |

(51) Int. Cl.
*F01M 13/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 1,812,566 | A * | 6/1931 | Spencer | 123/317 |
| 2,056,755 | A * | 10/1936 | Welch, Jr. | 123/41.86 |
| 2,252,974 | A * | 8/1941 | Lowther | 123/1 R |
| 3,589,347 | A * | 6/1971 | Sawada | 123/574 |
| 3,673,997 | A * | 7/1972 | Sawada | 123/519 |
| 3,750,634 | A * | 8/1973 | Nakajima et al. | 123/572 |
| 4,011,846 | A * | 3/1977 | Gagliardi | 123/568.15 |
| 4,136,650 | A * | 1/1979 | Manookian, Jr. | 123/573 |
| 4,515,137 | A * | 5/1985 | Manolis | 123/572 |
| 4,760,833 | A * | 8/1988 | Tatyrek | 123/574 |
| 5,897,597 | A * | 4/1999 | O'Daniel | 701/29 |
| 6,167,874 | B1 * | 1/2001 | Becker et al. | 123/572 |
| 6,435,170 | B1 * | 8/2002 | Hamelink et al. | 123/572 |

FOREIGN PATENT DOCUMENTS

| | | |
|---|---|---|
| JP | SHO.56-46015 | 10/1981 |
| JP | 62-42098 | 10/1987 |

* cited by examiner

*Primary Examiner*—Marguerite McMahon
(74) *Attorney, Agent, or Firm*—Carrier, Blackman & Associates, P.C.; Joseph P. Carrier; William D. Blackman

(57) ABSTRACT

A blowby gas ventilation system for an internal combustion engine capable of preventing oil from being diluted by efficiently and quickly exhausting a blowby gas together with a water content and the like from a crank chamber through forced ventilation of the crank chamber. The blowby gas ventilation system is intended for a four-stroke-cycle internal combustion engine. The system includes a fresh air introduction pipe, through which fresh air is sent from an outside of the internal combustion engine through a throttle portion to a crank chamber. The system also includes a blowby gas return passageway, through which the blowby gas is returned back to a downstream side of an air cleaner.

13 Claims, 9 Drawing Sheets

BLOWBY GAS VENTILATION SYSTEM FOR AN INTERNAL COMBUSTION ENGINE, AND METHOD OF USING SAME

CROSS-REFERENCE TO RELATED APPLICATIONS

The present invention claims priority under 35 USC 119 based on Japanese Patent Application No. 2003-305833, filed Aug. 29, 2003, and also based on Japanese Patent Application Nos. 2003-336223 and 2003-336226, each filed Sep. 26, 2003. The present invention further claims priority under 35 USC 119 based on Japanese Patent Application No. 2004-213496, filed Jul. 21, 2004. The complete disclosure of each of the above-referenced Japanese applications is incorporated by reference herein.

BACKGROUND OF THE INVENTION

1. Technical Field of the Invention

The present invention relates to a blowby gas ventilation system for a four-stroke-cycle internal combustion engine.

2. Background Art

It is known that, in a small-sized internal combustion engine in a small-sized vehicle such as a motorcycle, a blowby gas that leaks into a crankcase is recirculated to an air cleaner (see, for example, Patent Document 1).

[Patent Document 1]

Japanese Utility Model Publication No. Sho 56-46015

The blowby gas treatment apparatus disclosed in Patent Document 1 includes a blowby gas extraction pipe. A proximal end of the blowby gas extraction pipe is connected to an extraction port drilled in a crankcase. The blowby gas extraction pipe extends outwardly so that a distal end thereof is connected to an air cleaner through a separator.

The blowby gas extracted from the crankcase is separated into a gaseous content including a combustible content and a liquid content including an oil and the like. The gaseous content is recirculated to the air cleaner, while the liquid content is stored in a storage pipe before being exhausted.

Another arrangement is known, in which a good part of an oil content is separated in a breather chamber from the blowby gas leaking into the crankcase; the resultant blowby gas is introduced through a blowby gas guide pipe into a secondary air supply pipe before being burned in an exhaust manifold (see Patent Document 2).

[Patent Document 2]

Japanese Utility Model Publication No. Sho 62-42098

In the arrangement disclosed in Patent Document 1, the blowby gas is not forcibly extracted. The blowby gas therefore stagnates to some extent in the crankcase. During this period, a water content and a gasoline content that enter the crankcase with the blowby gas become saturated therein. As a result, the water content and the gasoline content are mixed with, and thus dilute, the oil. The oil is then deteriorated.

The arrangement disclosed in Patent Document 2, on the other hand, is not interested in an idea of introducing fresh air into the crankcase. The arrangement is therefore unable to discharge the blowby gas efficiently.

Although the known devices have some utility for their intended purposes, a need still exists in the art for improved handling of blowby gases from internal combustion engines. In particular, there is a need for an improved blowby gas ventilation system for use on internal combustion engines, and for methods of using the improved system.

SUMMARY OF THE INVENTION

It is therefore an object of the present invention to provide a blowby gas ventilation system for an internal combustion engine capable of preventing oil from being diluted by performing positive crankcase ventilation to discharge the blowby gas efficiently and quickly together with the water content and the like.

[Means for Solving the Problem and Effect of the Invention]

To achieve the aforementioned object, a blowby gas ventilation system as claimed in claim 1 of the present invention is intended for a four-stroke-cycle internal combustion engine having the following specific arrangements. The arrangements specifically include a fresh air introduction passageway and a blowby gas return passageway provided for the engine. The fresh air introduction passageway provides a path for fresh air being taken in from an outside of the internal combustion engine and sent into a crank chamber through a throttle portion. The blowby gas return passageway serves as a path for the blowby gas being returned to a downstream side of an air cleaner.

Forced ventilation of the crank chamber is achieved through the operations as detailed in the following. Specifically, fluctuations in pressure in the crank chamber produced as a result of pumping actions of a piston in the internal combustion engine send fresh air into the crank chamber through the throttle portion by way of the fresh air introduction passageway. The fresh air drawn into the crank chamber pushes the blowby gas out of the crank chamber toward the downstream side of the air cleaner. At the same time, a negative pressure present on the downstream side of the air cleaner works to draw the blowby gas out of the crank chamber.

A water content and a gasoline content that enter the crankcase with the blowby gas are therefore forced out of the crankcase. This eliminates a possibility that the water and gasoline contents will be mixed with oil in the crank chamber to dilute it. Deterioration of oil can therefore be inhibited.

In addition, the blowby gas is discharged to the downstream side of an air cleaner element of the air cleaner. There is therefore no chance that an oil mist in the crankcase will affect the air cleaner element.

In addition to the features as claimed in claim 1 of the present invention, the blowby gas ventilation system for the internal combustion engine as claimed in claim 2 of the present invention is characterized by the following point. Specifically, a one-way valve is provided, together with the throttle portion, for the fresh air introduction passageway.

The one-way valve prevents reverse flow occurring as a result of pumping actions of the piston for greater efficiency in ventilation. The oil mist from the crankcase can also be prevented from entering the air cleaner.

In addition to the features as claimed in claim 2 of the present invention, the blowby gas ventilation system for the internal combustion engine as claimed in claim 3 of the present invention is characterized by a pressure relief chamber provided therefor. The pressure relief chamber is formed on an inside of the crank chamber downstream of the one-way valve. The chamber communicates with the crank chamber through the throttle portion.

The arrangement is of a simple structure having the one-way valve located on an upper portion of the crank chamber, to which the fresh air introduction passageway is connected, and the pressure relief chamber provided on the downstream side of the one-way valve and communicating with the crank chamber by way of a throttle hole. A negative pressure built up in the crankcase as the piston moves is relieved by the pressure relief chamber through the throttle hole, thereby allowing the negative pressure to act on the one-way valve efficiently. At the same time, the throttle hole restricts entry of oil in the crankcase into the pressure relief chamber, thereby preventing the oil from affecting the one-way valve. Operating response of the one-way valve can therefore be enhanced and the amount of air drawn in can be appropriately controlled. A good crankcase ventilation effect can thus be maintained at all times and the amount of the blowby gas can be appropriately controlled.

In addition to the features as claimed in claim 3 of the present invention, the blowby gas ventilation system for the internal combustion engine as claimed in claim 4 of the present invention is characterized by the following point. Specifically, the pressure relief chamber is provided at a base portion of a cylinder portion that extends substantially horizontally from the crankcase.

The pressure relief chamber, in which fresh air is drawn, is provided at the base portion of the cylinder portion. This arrangement allows the blowby gas leaking from an area around the piston into the crankcase to be effectively ventilated with the fresh air. It can therefore be prevented that the water content or the gasoline content entering the crankcase with the blowby gas is mixed with, and thus deteriorates, the oil in the crankcase. Durability of the oil can therefore be enhanced even further.

A blowby gas ventilation system as claimed in claim 5 of the present invention is intended for a four-stroke-cycle internal combustion engine having the following specific arrangements. The arrangements specifically include a fresh air introduction passageway and a blowby gas return passageway provided for the engine. The fresh air introduction passageway provides a path for fresh air being taken in from an outside of the internal combustion engine and sent into a crank chamber through a one-way valve. The blowby gas return passageway serves as a path for the blowby gas being returned to a downstream side of an air cleaner.

The arrangements allow simple yet efficient blowby gas ventilation to be carried out using pumping actions of a piston. The water content or gasoline content that enters the crankcase with the blowby gas can therefore be forced out. There is therefore no chance of the water or gasoline content being mixed with, and thus diluting, the oil in the crank chamber. Deterioration of oil can thereby be inhibited.

In addition to the features as claimed in claim 1 or 5 of the present invention, the blowby gas ventilation system for the internal combustion engine as claimed in claim 6 of the present invention is characterized in that fresh air is drawn into the fresh air introduction passageway from the downstream side of the cleaner element of the air cleaner at a point upstream of a throttle valve.

Since the fresh air is drawn in from the downstream side of the cleaner element of the air cleaner, filtered clean fresh air can be drawn in.

In addition to the features as claimed in claim 1 or 5 of the present invention, the blowby gas ventilation system for the internal combustion engine as claimed in claim 7 of the present invention is characterized in that the blowby gas return passageway is provided with a one-way valve.

A completely one-way, smooth flow of ventilated air is formed, which effectively prevents oil from being deteriorated.

In addition to the features as claimed in claim 1 or 5 of the present invention, the blowby gas ventilation system for the internal combustion engine as claimed in claim 8 of the present invention is characterized by the following arrangements. The arrangements specifically include a control valve interposed at a midway point of the fresh air introduction passageway and an electronic control module for controlling the control valve according to an operating condition. The electronic control module controls the control valve so as to throttle or close the valve during an idle operation or a high-speed operation.

During the idle operation, the control valve is throttled or closed so as to inhibit crankcase ventilation. This permits accurate control of fuel, allowing an optimum air-fuel ratio to be maintained easily.

During the high-speed operation, the control valve is throttled or closed so as to inhibit crankcase ventilation. This prevents an increase in the amount of blowby gas during the high-speed operation from being promoted.

A crankcase ventilation system as claimed in claim 9 of the present invention is intended for a four-stroke-cycle internal combustion engine having the following specific arrangements. The arrangements specifically include a fresh air introduction passageway and a blowby gas return passageway provided for The engine. The fresh air introduction passageway provides a path for fresh air being drawn into a crankcase depending on fluctuations in pressure in the crankcase occurring as a result of reciprocating motions of a piston. The blowby gas return passageway serves as a path for the blowby gas in the crankcase being returned back to an intake system according to pressure fluctuations in the crankcase and an intake vacuum. A solenoid valve is provided in the fresh air introduction passageway. In addition, the blowby gas return passageway is kept in a state of constant communication with the fresh introduction passageway as shown.

The solenoid valve provided in the fresh air introduction passageway can be prevented from being subjected to effects from oil, gasoline, water, and the like contained in the blowby gas. The solenoid valve can therefore maintain an intended level of operating performance at all times. The blowby gas return passageway is therefore kept in the state of constant communication without being affected by operating conditions. Crankcase ventilation can therefore be effectively performed at all times to discharge the blowby gas from the crankcase efficiently.

In addition to the features as claimed in claim 9 of the present invention, the crankcase ventilation system for the internal combustion engine as claimed in claim 10 of the present invention is characterized by the following points. Specifically, a one-way valve is provided on an upper portion of the crankcase, to which the fresh air introduction passageway is connected. The one-way valve not only introduces fresh air according to a negative pressure in the crankcase, but also prevents the fresh air from flowing backward. Further, the solenoid valve is provided at a high level at a point in a descending passageway upstream of the one-way valve.

This arrangement ensures that the blowby gas flowed back from the one-way valve is properly returned without being stagnant in the descending passageway. The blowby gas thus does not affect the solenoid valve located at the high level in the descending passageway, thereby enhancing durability of the solenoid valve.

For a more complete understanding of the present invention, the reader is referred to the following detailed description section, which should be read in conjunction with the accompanying drawings. The detailed description section discloses the best mode currently contemplated for carrying out the invention. Throughout the following detailed description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the art.

A crankcase ventilation system according to a first illustrative embodiment of the present invention will be described with reference to FIGS. 1 through 5.

Figure 1:
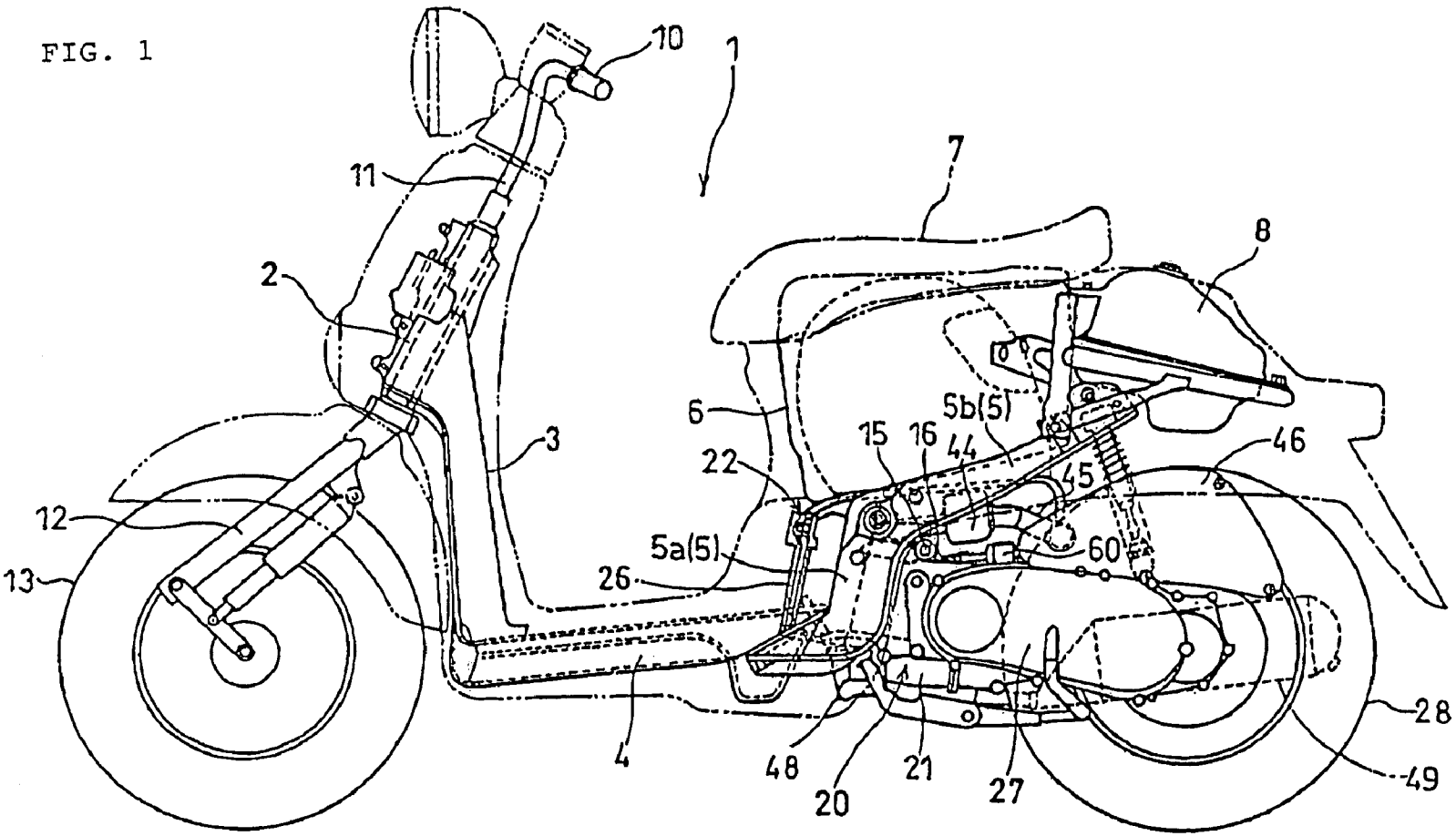
FIG. 1 is a left side elevational view of a scooter-type motorcycle incorporating a blowby gas ventilation system for an internal combustion engine according to a first illustrative embodiment of the present invention.

FIG. 1 is a left side elevational view showing a scooter-type motorcycle 1 provided with an internal combustion engine according to a first illustrative embodiment of the present invention.

A front body portion and a rear body portion of the motorcycle 1 are connected by a low floor portion. A body frame, forming a skeletal structure of the motorcycle, includes a front frame portion 3, a pair of right and left horizontal frame portions 4, 4, and a pair of right and left rear frame portions 5, 5.

The front frame portion 3 extends downwardly from a head pipe 2 at a front portion of the body. A lower end of the front frame portion 3 branches divergently into two parts to form the right and left horizontal frame portions 4, 4 which extend rearwardly along a path below the floor portion.

Each of the respective right and left rear frame portions 5, 5 includes an inclined portion 5*a* extending upwardly at a steep angle, and a substantially horizontal portion 5*b* extending rearwardly from the back end of the inclined portion 5*a*. Each of the inclined portions 5*a*, 5*a* is formed by rising obliquely rearwardly from a rear portion of the corresponding horizontal frame portion 4. The horizontal portions 5*b*, 5*b* then extend substantially horizontally and rearwardly, while maintaining an appropriate height.

A helmet storage box 6, integrated with a tail portion, is mounted on the horizontal portions 5*b*, 5*b* of the pair of right and left rear frame portions 5, 5. A seat 7 is provided on top of the helmet storage box 6, and the seat is pivotally movable so as to allow access to an opening of the helmet storage box 6.

A fuel tank 8 is mounted to a rear portion of the helmet storage box 6.

A steering shaft 11, having a handlebar 10 on an upper portion thereof, is provided at a front portion of the motorcycle body, and the steering shaft is pivotally connected to the head pipe 2. A front fork 12 is connected to a bottom side of the steering shaft 11. A front wheel 13 is journaled on a bottom end of the front fork 12, and the front wheel 13 is able to be steered by the handlebar 10.

A pivot post 15 is placed across a bent portion, over which the inclined portions 5*a*, 5*a* of the pair of right and left rear frame portions 5, 5 gradually change to the horizontal portions 5*b*, 5*b* thereof. The pivot post 15 journals a pair of right and left mount brackets 16, 16 provided in a protruding condition on a top surface of a cylinder portion of the unit swing case 21 of a powertrain unit 20, thereby rockably supporting the powertrain unit 20.

A crankcase 23 and a cylinder portion 24 are component parts of an internal combustion engine 22, provided at a front portion of the unit swing case 21 of the powertrain unit 20. A transmission case 27 extends rearwardly from a left-hand side of the crankcase 23. A rear wheel 28 is journaled on a rear portion of the transmission case 27. Power from the internal combustion engine 22 is transmitted to the rear wheel 28 by a belt-driven automatic transmission.

Figure 2:
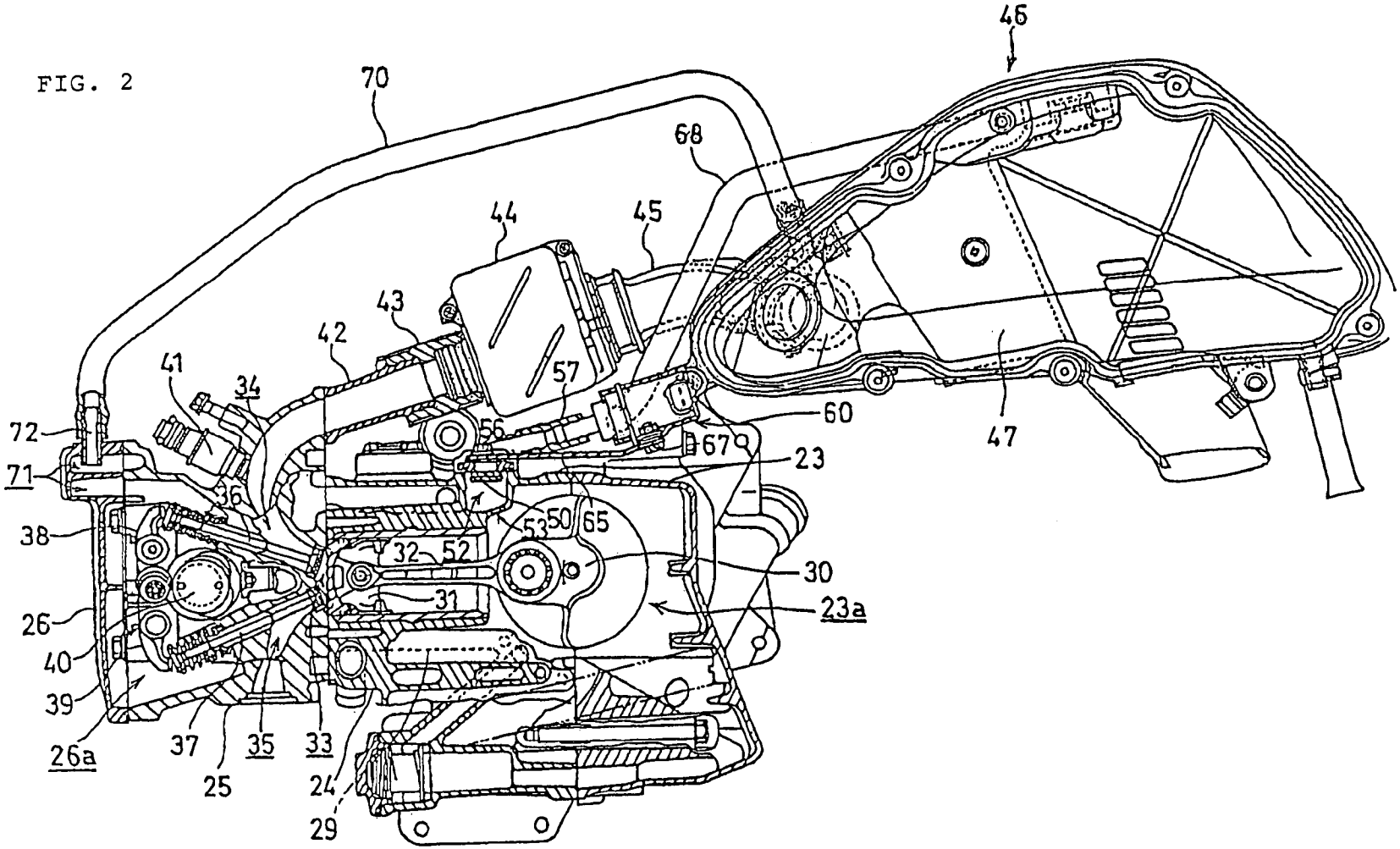
FIG. 2 is a partly sectional side elevational view showing an internal combustion engine including the blowby gas ventilation system according to the first embodiment
Figure 3:
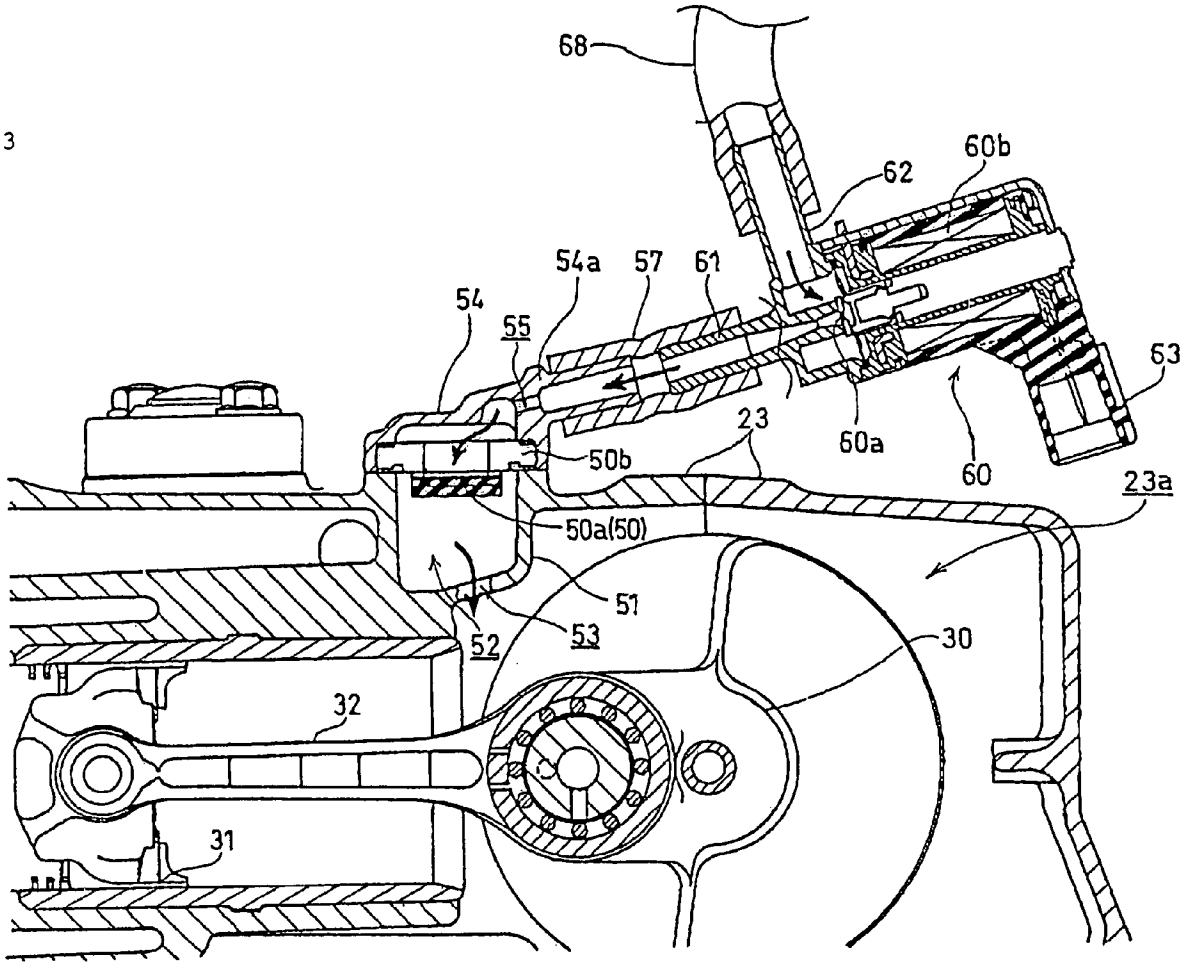
FIG. 3 is a cross sectional detail view showing in enlarged dimensions a principal part of the crankcase ventilation system of FIG. 2.

The internal combustion engine 22 is a single-cylinder, four-stroke-cycle internal combustion engine. Referring now to FIGS. 2-3, it will be seen that the cylinder portion 24 extends forwardly from the crankcase 23 on a level near a horizontal line. A cylinder head 25 and a cylinder head cover 26 are placed, in that order, forward of the cylinder portion 24 and are rigidly connected thereto.

The cylinder portion 24, the cylinder head 25, and the cylinder head cover 26 pass through a space between the inclined portions 5*a*, 5*a* of the pair of right and left rear frame portions 5, 5 (see FIG. 1).

The four-stroke-cycle internal combustion engine 22 is constructed as follows. Specifically, referring again to FIG. 2, a crankshaft 30 is pointed in a crosswise direction and journaled within a crank chamber 23*a* of the crankcase 23. A piston 31 is slidably fitted into a cylinder bore of the cylinder portion 24. The crankshaft 30 and the piston 31 are connected together by a connecting rod 32. A combustion gas is generated in a combustion chamber 33 formed adjacent an inner surface of the cylinder head 25 opposing the piston 31. The combustion gas causes the piston 31 to make a reciprocating motion, which rotationally drives the crankshaft 30.

An intake port 34 and an exhaust port 35 that open to the combustion chamber 33 are formed in an upper and lower portion, respectively, of the cylinder head 25. An intake valve 36 is provided to open or close an opening of the intake port 34. An exhaust valve 37 is provided to open or close an opening of the exhaust port 35.

Rocker arms 38, 39 are disposed in the cylinder head cover 26, oscillatably in contact with a cam of a camshaft 40.

The rocker arms 38, 39 drive the intake valve 36 and the exhaust valve 37, respectively.

A timing chain (not shown) is provided in a timing cover 29 that provides communication between a valve train chamber 26*a* of the cylinder head cover 26 and the crank chamber 23*a* of the crankcase 23. The timing chain is mounted across the camshaft 40 in the valve train chamber 26*a* and the crankshaft 30 in the crank chamber 23*a*. The camshaft 40 is turned at a speed half that of the crankshaft 30. The intake valve 36 and the exhaust valve 37 are thereby opened and closed at predetermined timings.

Referring to FIG. 2, the intake port 34 extends in a curved form on an upper portion of the cylinder head 25. A fuel injection valve 41 is fitted in the middle of the curvature. A combustion air intake pipe 42, connected to the intake port 34, extends rearwardly and obliquely upwardly. A throttle body 44 is connected by way of a connection pipe 43 to the combustion air intake pipe 42. An intake air duct 45 (see FIG. 4) extends obliquely forwardly from a front portion of a right side face of an air cleaner case 46*a* of an air cleaner 46 supported by the transmission case 27. The intake air duct 45 interconnects the throttle body 44 and the air cleaner case 46*a*.

The air cleaner 46 has an air cleaner element 47 that partitions an internal space thereof. The intake air duct 45 is connected to a filtered air side on a downstream end of the air cleaner 46.

An exhaust pipe 48, connected to the exhaust port 35 on the lower portion of the cylinder head 25, extends downwardly. The exhaust pipe 48 is routed downward of the crankcase 23 rearwardly so as to circumvent on to the right side. The pipe 48 is connected to a muffler 49 disposed on the right-hand side of the motorcycle body (see FIG. 1).

In the internal combustion engine 22 as constructed as described in the foregoing, referring to FIG. 3, a reed valve 50 is provided at a base of the cylinder portion 24 inclined substantially horizontally above the crankcase 23. A pressure relief chamber 52 is defined by a bulkhead 51 formed so as to extend into the crank chamber 23*a* on a downstream side of the reed valve 50. A throttle hole 53 is provided piercingly extending through a bottom portion of the bulkhead 51. The throttle hole 53 provides communication between the crank chamber 23*a*and the pressure relief chamber 52.

A rectangular opening is formed in the top of the pressure relief chamber 52. The reed valve 50 is provided in a tensioned state in the rectangular opening. A reed valve cover 54 is then mounted over the reed valve 50, to pinch and secure the reed valve 50 in position.

The reed valve 50 includes a flexible valve body 50*a* of a rectangular shape. The flexible valve body 50*a* has a proximal end thereof secured to a rectangular frame base 50*b*, with a distal end thereof being freely opened or closed. A longitudinal direction of the reed valve 50 is oriented in the direction of the crankshaft, or toward the crosswise direction of the motorcycle body. The reed valve 50 is provided in the tensioned state in a substantially horizontal position, so that the flexible valve body 50*a* opens and closes on the side of the pressure relief chamber 52 by having the rectangular frame base 50*b* mounted in an end face of the opening in the pressure relief chamber 52. The reed valve cover 54, of a generally rectangular shape as viewed from the above, is then placed on the reed valve from above, so as to sandwich the reed valve 50 with the end face in the opening of the pressure relief chamber 52. Right and left boss portions of the reed valve cover 54 are then secured with bolts 56, 56 (see FIG. 4).

A connection pipe portion 54*a* protrudes slightly obliquely upwardly and rearwardly from a right-hand side portion on an upper wall of the reed valve cover 54. A restriction passage 55, with a reduced diameter, is formed inside the connection pipe portion 54*a*.

A solenoid valve 60 is disposed on an extension from the connection pipe portion 54*a* that is inclined obliquely upwardly and rearwardly.

The solenoid valve 60 includes a valve body 60*a* that is opened or closed by a solenoid coil 60*b*. A connection pipe portion 61 having an open/close port to oppose the valve body 60*a* is disposed so as to oppose substantially concentrically relative to the connection pipe portion 54*a* of the reed valve cover 54. A flexible coupling hose 57 joins the connection pipe portion 61 and connection pipe portion 54*a*.

The solenoid valve 60 includes an inlet pipe portion 62 that protrudes from a base of the connection pipe portion 61 at right angles therewith. The inlet pipe portion 62 protrudes in a right direction relative to the motorcycle body.

For the purposes of illustration and to facilitate explanation, FIG. 3 shows a condition in which the solenoid valve 60 has been rotated 90 degrees about an axis of the connection pipe portion 61, thus making the inlet pipe portion 62 protrude upwardly. In reality, however, the inlet pipe portion 62 protrudes in the right direction relative to the motorcycle body, as shown in FIG. 4.

A female connector 63, serving as an electric connection terminal, protrudes from an end portion of the solenoid coil 60*b* in a left direction, which is opposite to the inlet pipe portion 62.

The solenoid valve 60, as described in the foregoing, is supported on the crankcase 23 through a mounting plate 65.

Figure 4:
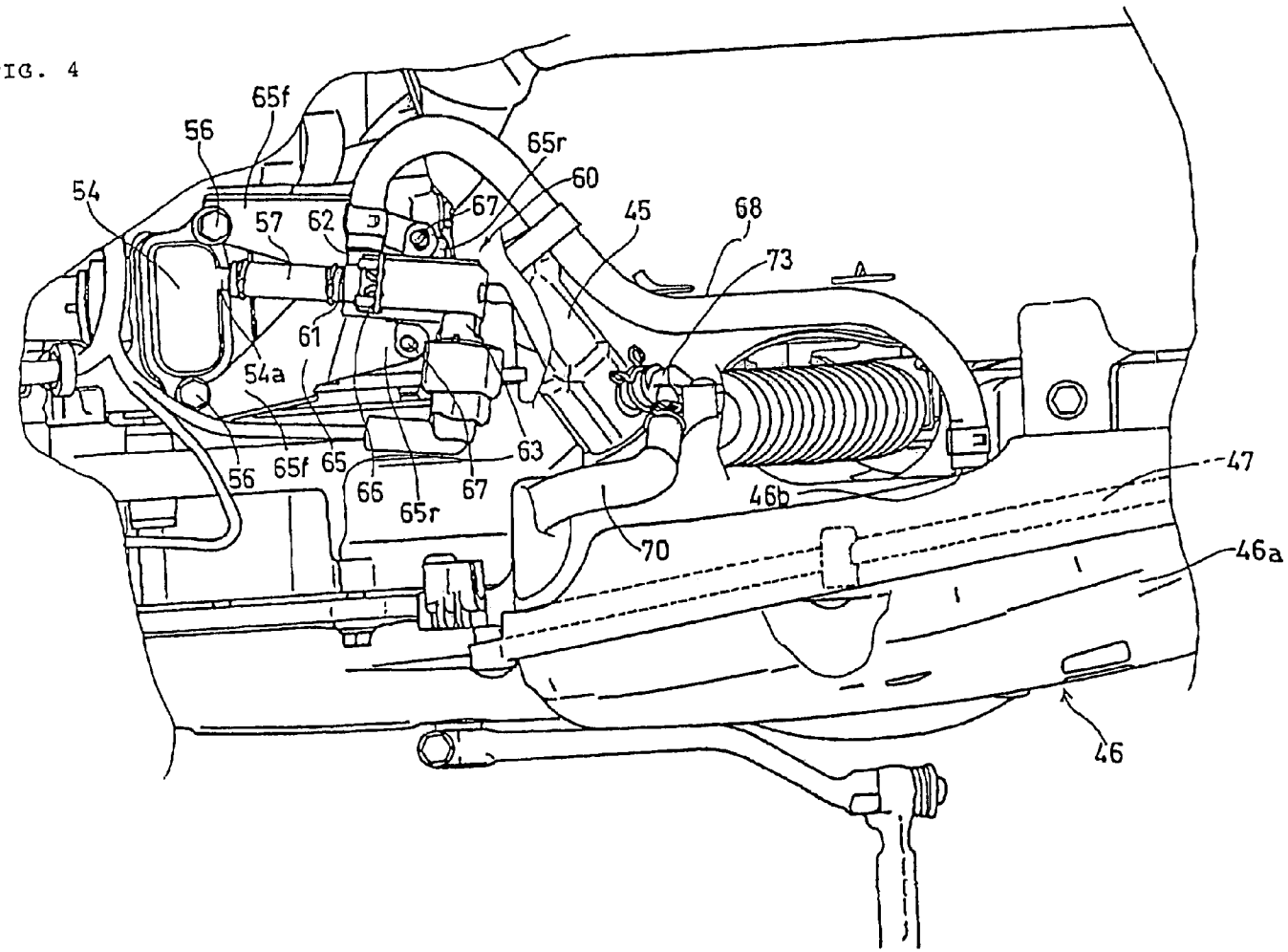
FIG. 4 is a top plan view showing the crankcase ventilation system of FIG. 2, with selected parts omitted from the drawing for illustrative purposes.

Referring now to FIGS. 2 and 4 (FIG. 4 is a plan view showing a principal portion with the combustion air intake pipe 42 and the throttle body 44 omitted), the mounting plate 65 is a sheet member. A pair of right and left proximal end arm portions 65*f*, 65*f* extends forwardly to form a two-forked portion. A pair of right and left distal end arm portions 65*r*, 65*r* extends rearwardly to form another two-forked portion.

End portions of the proximal end arm portions 65*f*, 65*f* at the front of the mounting plate 65 are tightened together using the bolts 56, 56 that are used to secure the reed valve cover 54 to the crankcase 23. The mounting plate 65 then extends rearwardly above the crankcase 23.

The solenoid valve 60 is located on a top surface in a latter half portion of the mounting plate 65 between the distal end arm portions 65*r*, 65*r* and mounted by a mounting bracket 66.

The mounting bracket 66 is fixed by bolts/nuts 67, 67 on both end portions of the distal end arm portions 65*r*, 65*r* of the mounting plate 65. The mounting bracket 66 thereby secures the solenoid valve 60 to the mounting plate 65.

The solenoid valve 60 is therefore supported by the mounting plate 65 in a position inclined forwardly and obliquely downwardly away from the crankcase 23. The solenoid valve 60 is thus free from direct thermal effect from the internal combustion engine 22.

A fresh air introduction hose 68 connects the inlet pipe portion 62 protruding in the right direction of the solenoid valve 60 and a connection pipe 46*b* (FIG. 4) protruding from a right side face of the air cleaner case 46*a*.

As described in the foregoing, the filtered air side of the air cleaner 46 is connected to the crank chamber 23*a* of the crankcase 23 through the fresh air introduction hose 68, the solenoid valve 60, the coupling hose 57, the reed valve cover 54, and the pressure relief chamber 52. This forms a fresh air introduction passageway to the crank chamber 23*a*.

Reference is now made to FIG. 2. A path of the fresh air introduction passageway formed from the solenoid valve 60 to the reed valve 50 by way of the oblique descending passageway connected with the coupling hose 57 runs substantially in parallel with an oblique path formed from the throttle body 44 to the intake port 34 on the upper portion of the cylinder head 25 by way of the combustion air intake pipe 42.

Further, this fresh air introduction path formed from the solenoid valve 60 to the reed valve 50 is disposed by making effective use of an acute-angle space formed between the oblique path and the top surface of the crankcase 23. These arrangements help make the entire internal combustion engine integrated compactly.

The helmet storage box 6 is situated above the throttle body 44 and the combustion air intake pipe 42. However, it is not necessary to move the throttle body 44 and the combustion air intake pipe 42 upward, because of the fresh air introduction passageway. This allows an adjustment space, in which the throttle body 44 moves with the unit swing case 21, to be easily secured below the helmet storage box 6.

This makes it possible to keep the height of the seat 7 low, while providing an ample capacity for the helmet storage box 6.

The reed valve 50 is installed in the tensioned state by making use of the space available at the base of the cylinder portion 24, above the crankcase 23. The reed valve 50 takes substantially the horizontal position so that the rectangular, flexible valve body 50*a* is placed with the longitudinal direction thereof oriented toward the crosswise direction of the motorcycle body. This also contributes to the low profile of the seat 7, while allowing the crankcase 23 to remain compact in size, and providing ample capacity of the helmet storage box 6.

The valve body 50*a* of the reed valve 50 opens and closes on the side of the pressure relief chamber 52. The reed valve 50 allows fresh air to be introduced from the air cleaner 46 to the pressure relief chamber 52 and the crank chamber 23*a*, while blocking flow in the opposite direction.

Figure 5:
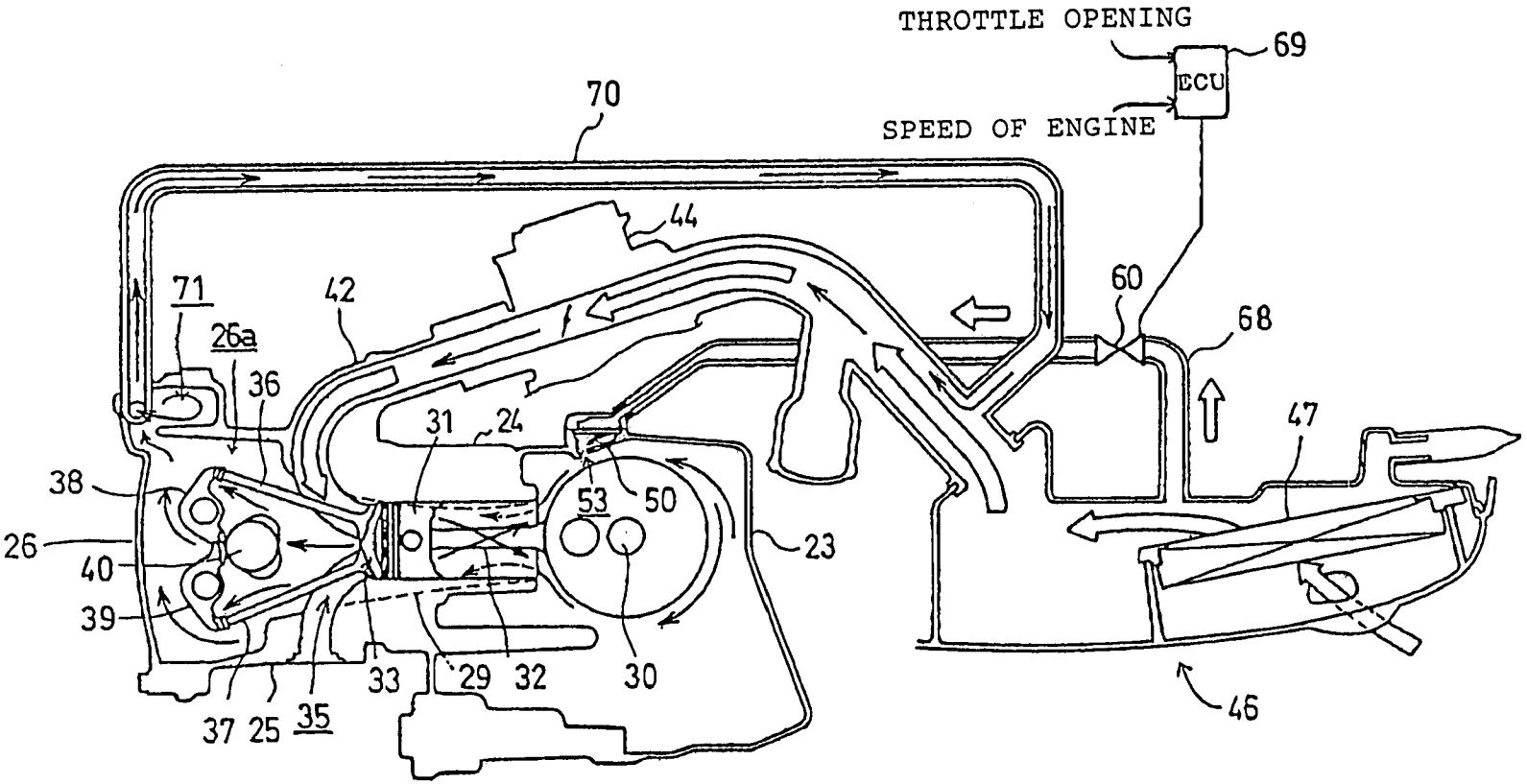
FIG. 5 is a schematic block diagram showing the blowby gas ventilation system according to the first illustrative embodiment.

The solenoid valve 60 is operated as controlled by an electronic control unit ECU 69 of a microprocessor, opening and closing the fresh air introduction passageway (see FIG. 5).

A blowby gas return hose 70 connects the cylinder head cover 26 with an upstream side of the intake air duct 45, located on the downstream side of the air cleaner 46. The blowby gas return hose 70 provides communication between the valve train chamber 26*a* and the intake air duct 45.

An upper portion of the cylinder head cover 26 that is inclined forward, and thus runs substantially horizontally, extends outwardly to form breather chambers 71. An upstream (inlet) end of the blowby gas return hose 70 is connected to a connection pipe 72 that is inserted in the breather chambers 71 from above. A downstream (outlet) end of the blowby gas return hose 70 is connected to one end of an L-shaped connection pipe 73 fitted to the intake air duct 45 (see FIG. 4).

As described in the foregoing, the blowby gas ventilation system includes the fresh air introduction hose 68, the blowby gas return hose 70, and the like.

FIG. 5 is a schematic block diagram schematically illustrating the blowby gas ventilation system.

When the solenoid valve 60 opens the fresh air introduction passageway as controlled by the ECU, the reed valve 50 is opened. The reed valve 50 opens in response to a negative pressure generated during pressure fluctuations in the crank chamber 23*a*, caused by pumping of the piston 31 in the internal combustion engine 22. Fresh air from the air cleaner 46 is then introduced into the crank chamber 23*a*, via the fresh air introduction hose 68 and the pressure relief chamber 52.

The fresh air drawn in works so as to push the blowby gas in the crank chamber 23*a*, moving the gas from the timing cover 29 to the valve train chamber 26*a*. The blowby gas then undergoes vapor-liquid separation in the breather chamber 71. Then, the blowby gas is moved from the valve train chamber 26*a* through the blowby gas return hose 70, and is discharged to the downstream side of the air cleaner 46. The negative pressure present in the downstream side of the air cleaner 46 draws in the blowby gas, thereby returning the blowby gas back to the combustion chamber 33 for re-burning. In the above-described manner, the crank chamber 23*a* is forcibly ventilated.

Water content and gasoline component, together with the blowby gas, that enter the crank chamber 23*a* are therefore forced out. This reduces or eliminates the possibility of these components mixed with oil thinning the oil, thus inhibiting the oil from being deteriorated.

The blowby gas is returned to the downstream of the air cleaner 46, and is therefore not allowed to be discharged into the atmosphere.

The crankcase ventilation system is simply structured. The reed valve 50 is located on the upper portion of the crankcase 23, to which the fresh air introduction passageway is connected. The pressure relief chamber 52, provided downstream of the reed valve 50, communicates with the crank chamber 23*a* via the throttle hole 53.

The negative pressure, generated in the crankcase 23 through movement of the piston 31, can be eased by the pressure relief chamber 52 through the throttle hole 53, before efficiently acting on the reed valve 50. The throttle hole 53 controls entry of oil in the crank chamber 23*a* into the pressure relief chamber 52, thereby preventing the oil from affecting the reed valve 50. A high level of operating response of the reed valve 50 can therefore be maintained. The amount of air drawn in can be properly controlled to maintain a good crankcase ventilation effect. Further, the amount of blowby gas can be properly controlled.

The pressure relief chamber 52, in which fresh air is introduced, is provided at the base of the cylinder portion 24. The blowby gas leaking through a space around the piston 31 into the crankcase 23 can therefore be effectively ventilated with the fresh air introduced through the throttle hole 53 of the pressure relief chamber 52. This in turn prevents the water content and gasoline component entering the crankcase 23 with the blowby gas from being mixed with, and thus deteriorating, oil. Durability of the oil can therefore be further enhanced.

The restriction passage 55 is formed inside the connection pipe portion 54*a* that is provided in the reed valve cover 54. As previously noted, the reed valve cover 54 is provided for covering the upstream side of the reed valve 50, and is connected to the fresh air introduction passageway. This makes for easy control of the amount of fresh air and helps reduce the number of parts used.

The restriction passage 55 formed inside the connection pipe portion 54*a* can be made sufficiently long to offer a good throttling effect. The restriction passage 55 can therefore be made to have a moderately large inner diameter, for preventing the restriction passage 55 from becoming plugged up with dust and dirt.

The solenoid valve 60 is provided in the fresh air introduction passageway. This prevents the solenoid valve 60 from being affected by the oil, gasoline, water, or the like contained in the blowby gas. This allows the solenoid valve 60 to maintain good operating performance at all times.

The blowby gas return passageway is not, on the other hand, provided with any solenoid or other valve, and is therefore kept in communication with the crankcase ventilation system at all times, without being affected by operating conditions. This provides effective ventilation for the crankcase 23 at all times, thus allowing the blowby gas to be efficiently discharged.

The fresh air introduction passageway is a descending passageway inclined obliquely forwardly, connecting from the solenoid valve 60 to the reed valve 50 with the coupling hose 57. The blowby gas flowed back from the reed valve 50 does not therefore stagnate in the descending passageway, being properly returned back into the crankcase 23 (pressure relief chamber 52). The solenoid valve 60 installed at a high level in the descending passageway is not therefore affected by the blowby gas, and thus, durability of the solenoid valve 60 is enhanced.

The ECU 69, providing the driving control for the solenoid valve 60, receives inputs of information on throttle position and on an instantaneous rotary speed of the internal combustion engine 22, to determine whether the motorcycle is running at an idle operation or a high-speed operation.

The ECU provides a control during idle operation or high-speed operation so as to throttle the solenoid valve 60 to a more closed or fully closed position.

It is easy to precisely meter fuel and maintain a proper air-fuel ratio by inhibiting ventilation of the crank chamber 23*a* by throttling the solenoid valve 60 to a more closed or fully closed position during idle operation.

It is also possible to prevent an increase in the amount of blowby gas from being promoted during high speed operation by inhibiting ventilation of the crank chamber 23*a* by throttling the solenoid valve 60 to a more closed or fully closed position during high speed operation.

In accordance with the first illustrative embodiment of the present invention as described in the foregoing, the solenoid valve 60 is connected to the reed valve cover 54 with the coupling hose 57. A modified example will be described in the following, in which the solenoid valve 60 is installed and disposed differently from the preferred embodiment of the present invention described in the foregoing.

Different reference numerals are used to denote different members.

Figure 6:
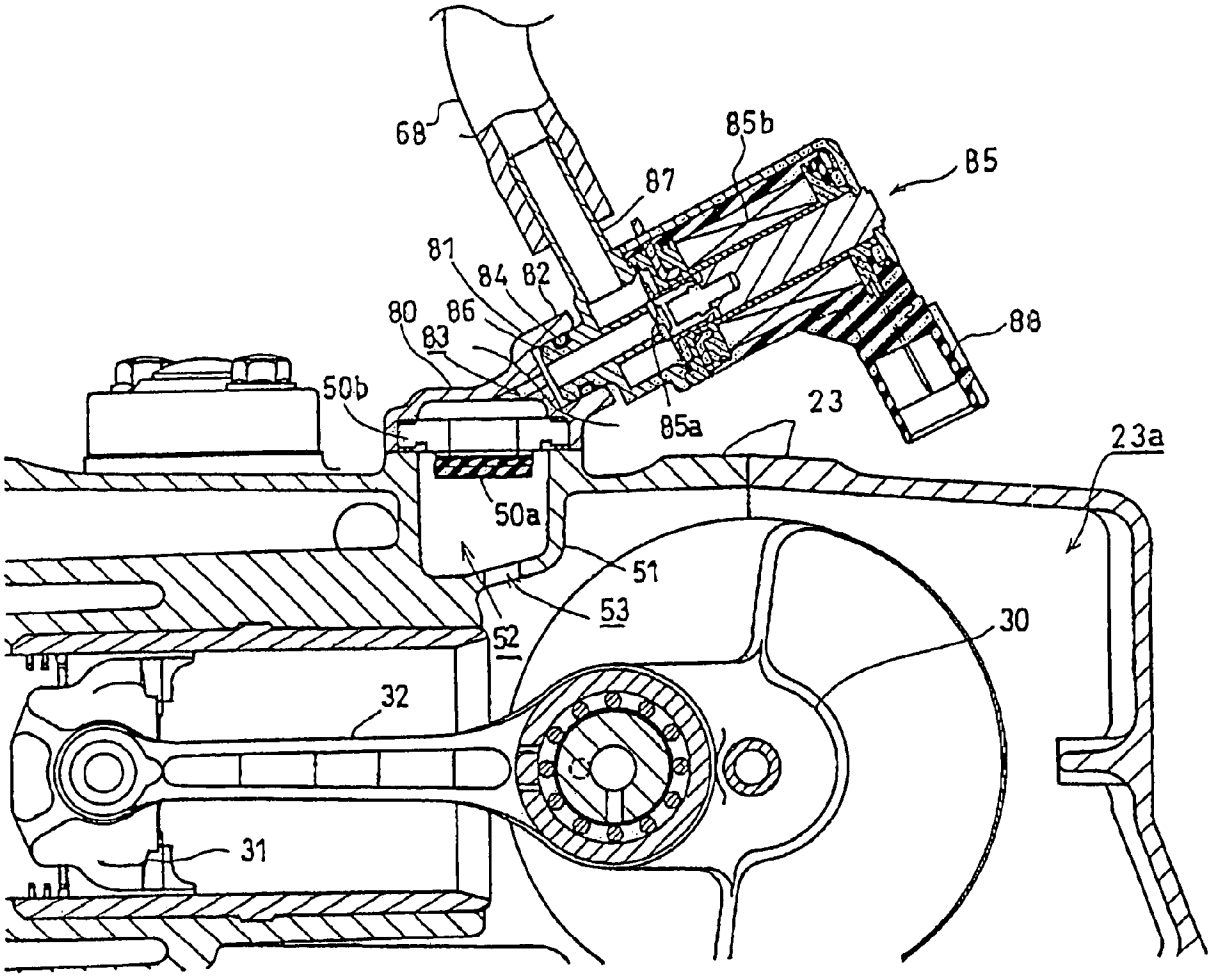
FIG. 6 is a cross sectional detail view showing in enlarged dimensions a principal part of a crankcase ventilation system according to a second illustrative embodiment of the present invention.

The example shown in FIG. 6 is a structure, in which a solenoid valve 85 is mounted directly on a reed valve cover 80.

A connection pipe portion 81 protrudes obliquely upwardly in rear of the reed valve cover 80. An insertion hole 82 of a large diameter is formed in the connection pipe portion 81. There is, on the side of the solenoid valve 85, a connection pipe portion 86 having an open/close port that opposes a valve body 85*a* opened or closed by a solenoid coil 85*b*. The connection pipe portion 86 is relatively short in length and is fitted into the insertion hole 82 in the reed valve cover 80.

A sealing member 84 is fitted in an outer peripheral groove in the connection pipe portion 86 of the solenoid valve 85. The sealing member 84 provides an airtight sealing for a connection portion between the insertion hole 82 and the connection pipe portion 86.

Except for the connection pipe portion 86, the solenoid valve 85 has the same structure as the solenoid valve 60. An inlet pipe portion 87 protrudes in the right direction, while a connector 88 protrudes in the left direction. (For the sake of explanation, FIG. 6 shows a condition, in which the solenoid valve 85 is rotated 90 degrees about an axis of the connection pipe portion 86.)

A restriction passage 83 is formed on the downstream side of the insertion hole 82 in the connection pipe portion 81.

The solenoid valve 85 can be brought nearer to the crankcase 23, allowing the entire internal combustion engine to be built compactly.

There is no need of using a coupling pipe, which helps reduce the number of parts used.

Figure 7:
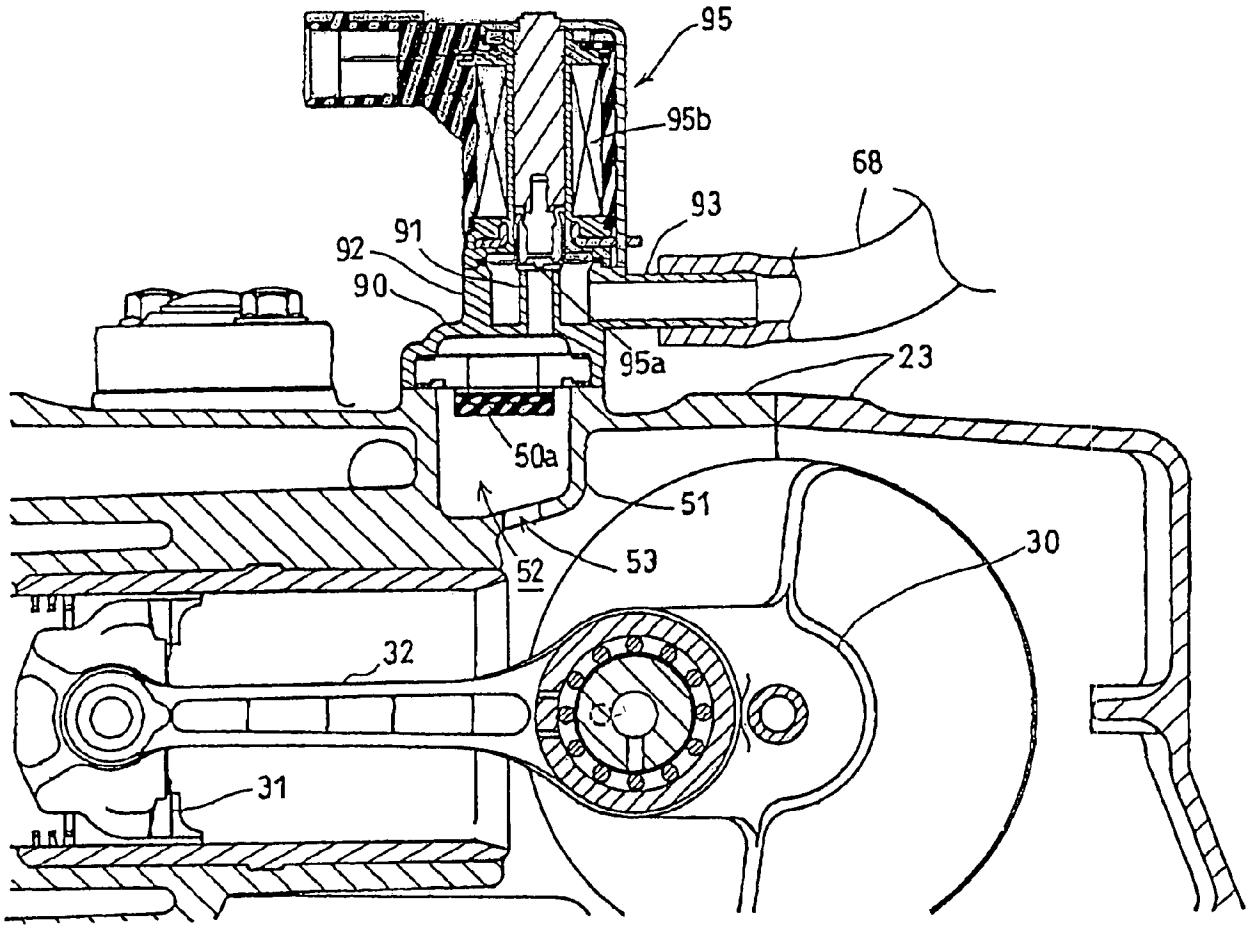
FIG. 7 is a cross sectional detail view showing in enlarged dimensions a principal part of a crankcase ventilation system according to a third illustrative embodiment of the present invention.

Another example will be described with reference to FIG. 7, in which a solenoid valve 95 is integrally built into an upper portion of a reed valve cover 90.

An inner cylinder portion 91 has, in an upper wall of the reed valve cover 90, an open/close port that opposes a valve body 95*a* that is opened or closed by a solenoid coil 95*b* of the solenoid valve 95. The inner cylinder portion 91 protrudes upwardly. An outer cylinder portion 92 is formed on an outer circumference of the inner cylinder portion 91 with an annular space interposed therebetween. An inlet pipe portion 93 is formed in a condition protruding sideways from the outer cylinder portion 92. A fresh air introduction hose 68 is connected to the inlet pipe portion 93.

The solenoid coil 95*b* of the solenoid valve 95 is installed in an upward protruding condition. A connector 96 protrudes sideways from an upper end portion.

As described in the foregoing, the reed valve cover 90 is an integral structure functioning also as a fresh air intake/exhaust portion of the solenoid valve 95. This makes for an even more compact body.

Still another example will be described with reference to FIG. 8, in which a solenoid valve 100 is disposed on the side of an air cleaner 105.

Figure 8:
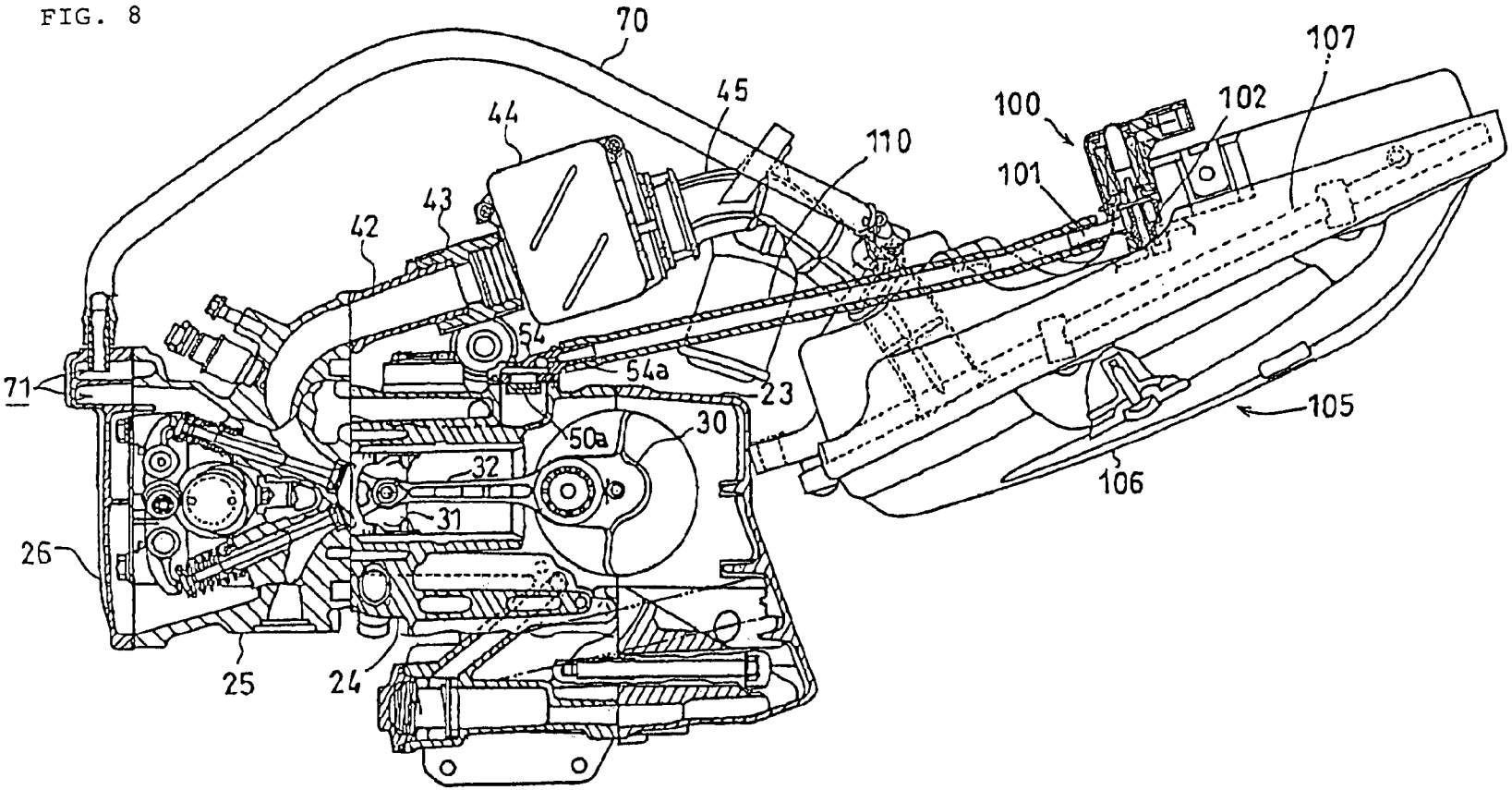
FIG. 8 is a partly sectional side elevational view showing an internal combustion engine including a blowby gas ventilation system according according to a fourth embodiment of the present invention.

FIG. 8 shows a condition, in which an air cleaner case 106 of an air cleaner 105 is rotated 90 degrees relative to the internal combustion engine 22 from an actual position.

In this example, the same type as that shown in FIG. 6 is used for a reed valve cover 54.

The solenoid valve 100 is installed in such a manner that an inlet pipe portion 102 is inserted into a right side face of the air cleaner case 106. Fresh air on a downstream filtered air side of an air cleaner element 107 of the air cleaner 105 can therefore be introduced.

A fresh air introduction hose 110 connects a connection pipe portion 101 that protrudes sideways the solenoid valve 100 and a connection pipe portion 54*a* of the reed valve cover 54 on an upper portion of the crankcase 23.

The fresh air introduction hose 110 is connected to the connection pipe portion 54*a* that protrudes rearwardly and obliquely upwardly the reed valve cover 54 on the upper portion of the crankcase 23, thus extending rearwardly. This provides an extra space upward of the crankcase 23, thereby enhancing the degree of freedom in layout.

The arrangement according to this example is effective when there is no extra space available between the crankcase 23 and the helmet storage box 6.

An embodiment for another internal combustion engine will be described with reference to FIG. 9 in the following.

An internal combustion engine 151 is constructed as follows. Specifically, a cylinder of a cylinder block 153 extends substantially upwardly from a crankcase 152. A cylinder head 154 is connected integrally with an upper portion of the cylinder block 153. The cylinder head 154 is then capped with a cylinder head cover 155.

A crankshaft 156 is connected to a piston 157 by a connecting rod 158 in a crank chamber 152*a*. Reciprocating motions of the piston 157 result in the crankshaft 156 being rotated.

An intake port 160 and an exhaust port 161 that are open to a combustion chamber 159 are formed in the cylinder head 154. An intake valve 162 is provided to open an opening at the intake port 160. An exhaust valve 163 is provided to open an opening at the exhaust port 161.

An intake pipe 170 extends from the intake port 160 of the cylinder head 154 of the internal combustion engine 151. The intake pipe 170 is connected to a carburetor (or a fuel injection valve) 172. A connecting tube 173 connects the carburetor 172 to an air cleaner 174.

A blowby gas ventilation system 180 is constructed as detailed in the following. Specifically, a fresh air introduction pipe 181 connects the crankcase 152 and an air cleaner case 175. The fresh air introduction pipe 181 thereby provides communication between the crank chamber 152*a* and an inside of the air cleaner case 175. A blowby gas exhaust pipe 185 connects the cylinder head cover 155 and upstream side of the connecting tube 173 on a downstream side of the air cleaner 174. The blowby gas exhaust pipe 185 thereby provides communication between a valve train chamber 155*a* and an inside of the connecting tube 173.

The fresh air introduction pipe 181 may be brought into communication with a filtered air side downstream of the air cleaner 174.

A throttle portion 182 is formed at a connection of the fresh air introduction pipe 181 to the crankcase 152. There is also a reed valve 183 interposed at the connection between the fresh air introduction pipe 181 and the crankcase 152.

A reed valve 186 is interposed between the blowby gas exhaust pipe 185 and the cylinder head cover 155 at a point closer to the cylinder head cover 155.

The reed valve 186 may not be absolutely necessary.

Figure 9:
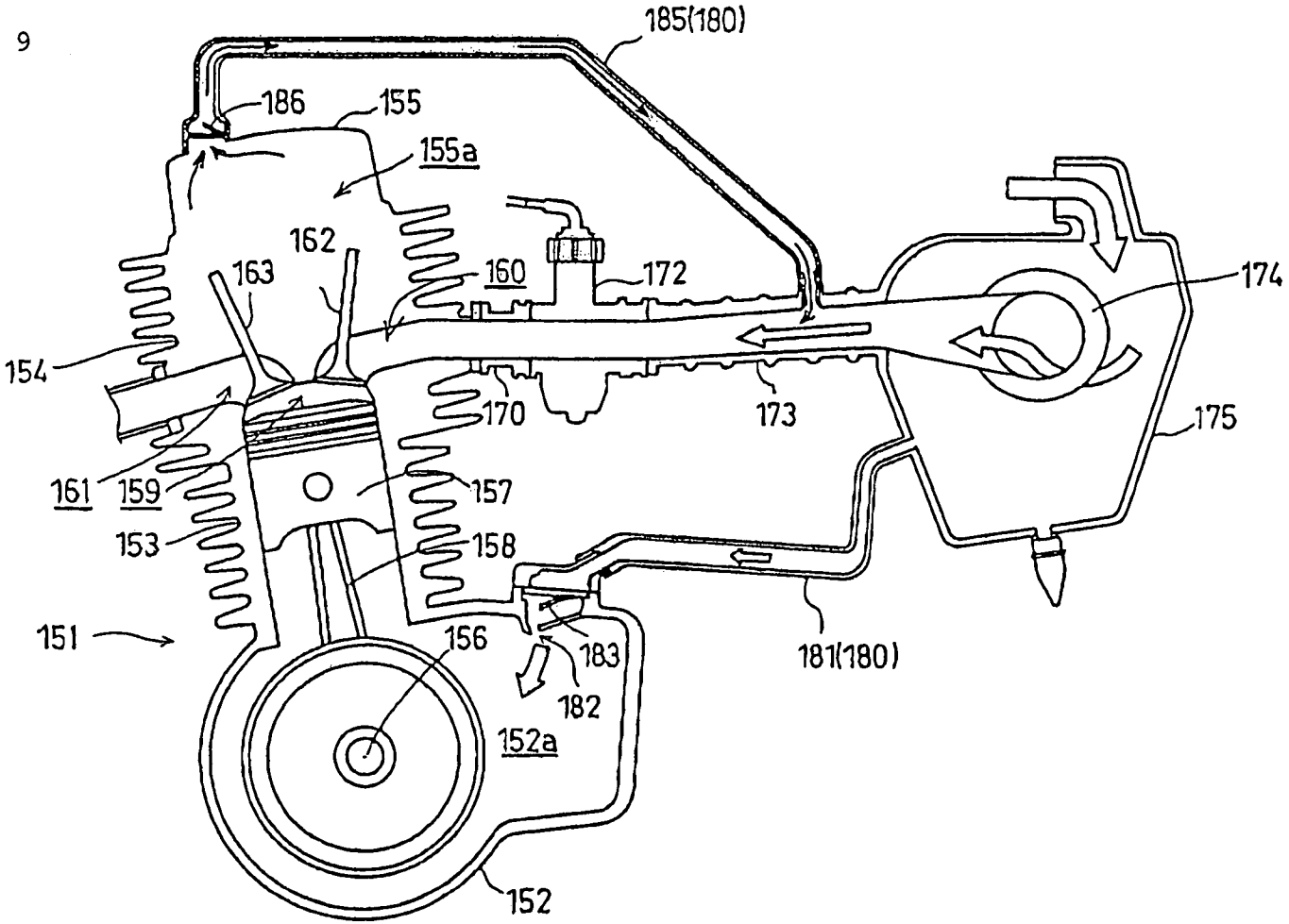
FIG. 9 is a schematic block diagram showing an internal combustion engine and a blowby gas ventilation system according to another embodiment of the present invention.

The reed valve 183 therefore ensures that the intake of fresh air through the fresh air introduction pipe 181 from the air cleaner 174 to the crank chamber 152*a* flows in one direction only (see the outlined arrow in FIG. 9). Further, the reed valve 183 ensures that the exhaust of the blowby gas through the blowby gas exhaust pipe 185 from the valve train chamber 155*a* to the downstream side of the air cleaner 174 flows in one direction only (see the solid arrow in FIG. 9). The reed valve 183 thus prevents reverse flow, forming an exhaust flow of one direction only. Deterioration of oil can therefore be effectively prevented.

The internal combustion engine according to the preferred embodiment of the present invention is a single cylinder type. The invention is nonetheless applicable to an internal combustion engine having a plurality of cylinders, as long as such an engine involves pressure fluctuations occurring at periodic intervals in the crank chamber through movements of the piston. The invention can be applied to, for example, an internal combustion engine having a plurality of cylinders opposed horizontally.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

We claim:

1. In a four-stroke-cycle internal combustion engine, a blowby gas ventilation system comprising:

a fresh air introduction passageway for introducing fresh air into a crank chamber from outside of the internal combustion engine, said fresh air introduction passageway having a reduced-diameter restriction therein;

a blowby gas return passageway for returning a blowby gas back to a downstream side of an air cleaner;

a one-way check valve provided in the fresh air introduction passageway, the one-way check valve being connected in series with the restriction; and p1 a pressure relief chamber is formed inside of the crank chamber downstream of the one-way check valve, wherein the pressure relief chamber communicates with the crank chamber through a throttle hole.

2. The blowby gas ventilation system according to claim 1, wherein the pressure relief chamber is provided at a base portion of a cylinder portion that extends substantially horizontally from a crankcase.

3. The blowby gas ventilation system according to claim 1, wherein fresh air is drawn into the fresh air introduction passageway downstream of an air cleaner element, and at a point upstream of a throttle valve.

4. The blowby gas ventilation system according to claim 1, wherein the one-way check valve is mounted in the blowby gas return passageway.

5. The blowby gas ventilation system according to claim 1, further comprising:

a control valve interposed at a midway point of the fresh air introduction passageway; and an electronic control module for controlling the control valve according to an operating condition;

wherein the electronic control module controls the control valve so as to throttle or close the control valve during an idle operation or a high speed operation.

6. In a four-stroke-cycle internal combustion engine, a blowby gas ventilation system comprising:

a fresh air introduction passageway for introducing fresh air into a crank chamber through a one-way check valve from outside of the internal combustion engine;

a blowby gas return passageway for returning a blowby gas back to a downstream side of an air cleaner; and a pressure relief chamber formed inside of the crank chamber downstream of the one-way check valve, wherein the pressure relief chamber communicates with the crank chamber through a throttle hole.

7. The blowby gas ventilation system according to claim 5, wherein the control valve is a solenoid valve.

8. In a four-stroke-cycle internal combustion engine, a blowby gas ventilation system comprising:

a fresh air introduction passageway for introducing fresh air into a crankcase depending on fluctuations in pressure in a crankcase occurring as a result of a reciprocating motion of a piston; and a blowby gas return passageway for returning a blowby gas in the crankcase back to an intake system according to fluctuations in pressure in the crankcase and an intake vacuum;

a solenoid valve provided for the fresh air introduction passageway and the blowby gas return passageway being kept in a state of constant communication with the fresh air introduction passageway; and a one-way check valve that introduces fresh air according to a negative pressure in the crankcase, and prevents the fresh air from flowing backward being provided on an upper portion of the crankcase, to which the fresh air introduction passageway is connected; and wherein the solenoid valve is provided at a high level at a point in a descending passageway upstream of the one-way check valve.

9. A method of ventilating blowby gas in a four-stroke-cycle internal combustion engine, said method comprising the steps of:

selectively routing fresh air into a crank chamber of the engine from outside of the internal combustion engine via a fresh air introduction passageway having a reduced-diameter restriction therein; and returning a blowby gas from a cylinder head cover of the engine back to a downstream side of an air cleaner via a blowby gas return passageway; wherein a one-way check valve is provided in the fresh air introduction passageway, said check valve being connected in series with the restriction;

a pressure relief chamber is formed inside of the crank chamber downstream of the one-way check valve;

a bullhead is formed between said crank chamber and said pressure relief chamber; and the pressure relief chamber communicates with the crank chamber through a throttle hole formed in said bulkhead.

10. The method of claim 9, wherein a solenoid valve is provided in the fresh air introduction passageway, and further comprising a step of controlling operation of said check valve using an electronic control module.

11. The method of claim 10, wherein said electronic control module controls said solenoid based in part on sensed information relating to throttle position and instantaneous engine speed.

12. The method of claim 9, wherein fresh air is drawn into the fresh air introduction passageway downstream of an air cleaner element, and at a point upstream of a throttle valve.

13. The method of claim 9, wherein the engine further comprises:

a control valve interposed at a midway point of the fresh air introduction passageway; and an electronic control module for controlling the control valve according to an operating condition; wherein the electronic control module controls the control valve so as to throttle or close the control valve during an idle operation or a high speed operation.

* * * * *